US006979174B2

(12) United States Patent
Watson et al.

(10) Patent No.: US 6,979,174 B2
(45) Date of Patent: Dec. 27, 2005

(54) STAGE PUMP HAVING COMPOSITE COMPONENTS

(75) Inventors: Arthur I. Watson, Sugar Land, TX (US); Dwight C. Chilcoat, Fresno, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 154 days.

(21) Appl. No.: 10/676,319

(22) Filed: Oct. 1, 2003

(65) Prior Publication Data

US 2005/0074330 A1 Apr. 7, 2005

(51) Int. Cl.[7] ..... F01D 1/02

(52) U.S. Cl. ..... 415/200; 415/199.1; 415/915; 416/198 R

(58) Field of Search ..... 415/199.1, 199.2, 415/200, 211.2, 915; 416/241 A, 198 R; 417/423.3

(56) References Cited

U.S. PATENT DOCUMENTS

| | | | | |
|---|---|---|---|---|
| 3,155,045 A | | 11/1964 | Lown et al. | |
| 3,158,295 A | * | 11/1964 | McConaghy | 415/199.2 |
| 3,265,001 A | * | 8/1966 | Deters | 415/200 |
| 3,408,944 A | | 11/1968 | Belonger et al. | |
| 3,670,382 A | | 6/1972 | Keehan | |
| 3,730,641 A | * | 5/1973 | Gordon | 416/186 R |
| 3,779,668 A | * | 12/1973 | Ekey | 416/186 R |
| 4,147,819 A | | 4/1979 | Hukumoto et al. | |
| 4,396,658 A | | 8/1983 | Mettes et al. | |
| 5,015,686 A | | 5/1991 | Kallenbach et al. | |
| 5,314,321 A | | 5/1994 | Yamamoto et al. | |
| 5,692,880 A | * | 12/1997 | Zelder | 416/185 |
| 6,368,056 B1 | * | 4/2002 | Rabinovich et al. | 415/199.2 |
| 6,393,208 B1 | | 5/2002 | Nosenchuck | |
| 6,439,835 B1 | * | 8/2002 | Chien et al. | 415/104 |
| 6,481,961 B1 | * | 11/2002 | Pai | 415/199.2 |
| 6,688,860 B2 | * | 2/2004 | Du et al. | 417/423.11 |

FOREIGN PATENT DOCUMENTS

| | | |
|---|---|---|
| JP | 61283797 A | 12/1986 |

* cited by examiner

*Primary Examiner*—Edward K. Look
*Assistant Examiner*—Igor Kershteyn
(74) *Attorney, Agent, or Firm*—Robert VanSomeren; Bryan P. Galloway; Jaime A. Castano

(57) ABSTRACT

A system and method is provided for pumping fluid. A pump incorporates composite components that provide a high degree of formability while maintaining wear resistance for use in potentially abrasive environments. The composite components may comprise one or more impellers and/or one or more diffusers.

38 Claims, 4 Drawing Sheets

STAGE PUMP HAVING COMPOSITE COMPONENTS

BACKGROUND

In a variety of environments, such as wellbore environments, pumps are used to produce or otherwise move fluids. For example, multiple stage, centrifugal pumps are used in the production of oil. A centrifugal pump is connected into an electric submersible pumping system located, for example, in a wellbore drilled into an oil-producing formation. The centrifugal pump uses a plurality of stages with each stage having an impeller and a diffuser. The impellers are rotated by a shaft to move the fluid, while the diffusers guide the flowing fluid from one impeller to the next.

The fluid can contain particulate matter, such as sand, having abrasive properties. As the fluid flows through the pump, the particulate matter can abrade pump components, potentially shortening the life of the pump. Certain components, such as impellers and diffusers, are particularly susceptible to abrasion during operation of the pump.

SUMMARY

In general, the present invention provides a system and method that facilitates the pumping of fluids, such as fluids found in a subterranean formation. A pump utilizes pump components that are readily formed to enable the improvement of various pumping parameters, such as pumping efficiency. However, the structure of the pump components enables maintenance of high wear resistance for use in abrasive environments.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a system and method for pumping fluids. The system and method are useful with, for example, a variety of electric submersible pumping systems. However, the devices and methods of the present invention are not limited to use in the specific applications described herein to enhance the understanding of the reader.

Figure 1:
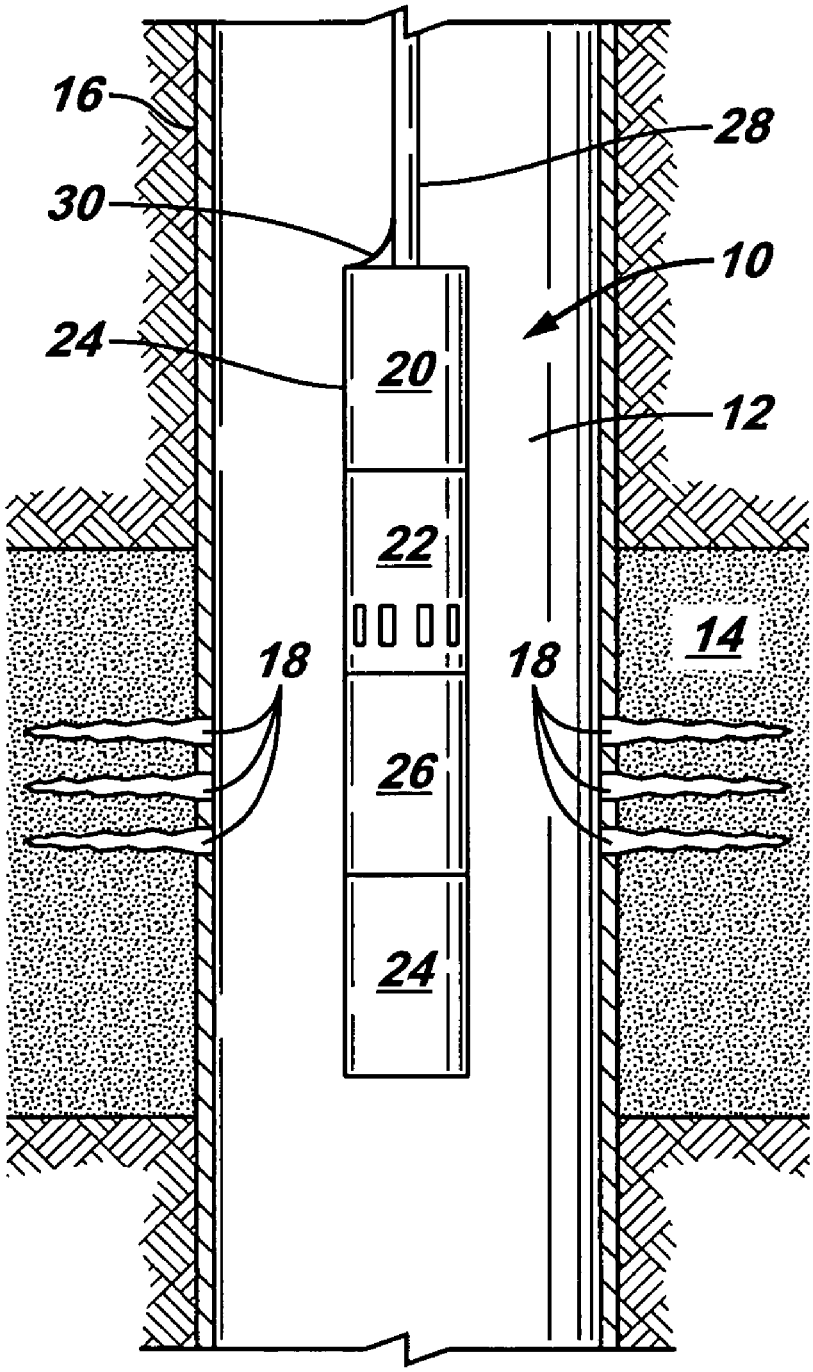
FIG. 1 is a front elevational of view of a submersible pumping system having a pump, according to an embodiment of the present invention.

Referring generally to FIG. 1, an example of an electric submersible pumping system 10 is illustrated. Although system 10 can be utilized in numerous environments, one type of environment is a subterranean environment in which system 10 is located within a wellbore 12. Wellbore 12 may be located in a geological formation 14 containing fluids, such as oil. In certain applications, wellbore 12 is lined with a wellbore casing 16 having perforations 18 through which fluid flows from formation 14 into wellbore 12.

In the embodiment illustrated, system 10 comprises a pump 20 having a pump intake 22. System 10 further comprises a submersible motor 24 and a motor protector 26 disposed between submersible motor 24 and submersible pump 20. System 10 is suspended within wellbore 12 by a deployment system 28. Deployment system 28 may comprise, for example, production tubing, coiled tubing or cable. A power cable 30 is routed along deployment system 28 and electric submersible pumping system 10 to provide power to submersible motor 24.

Figure 2:
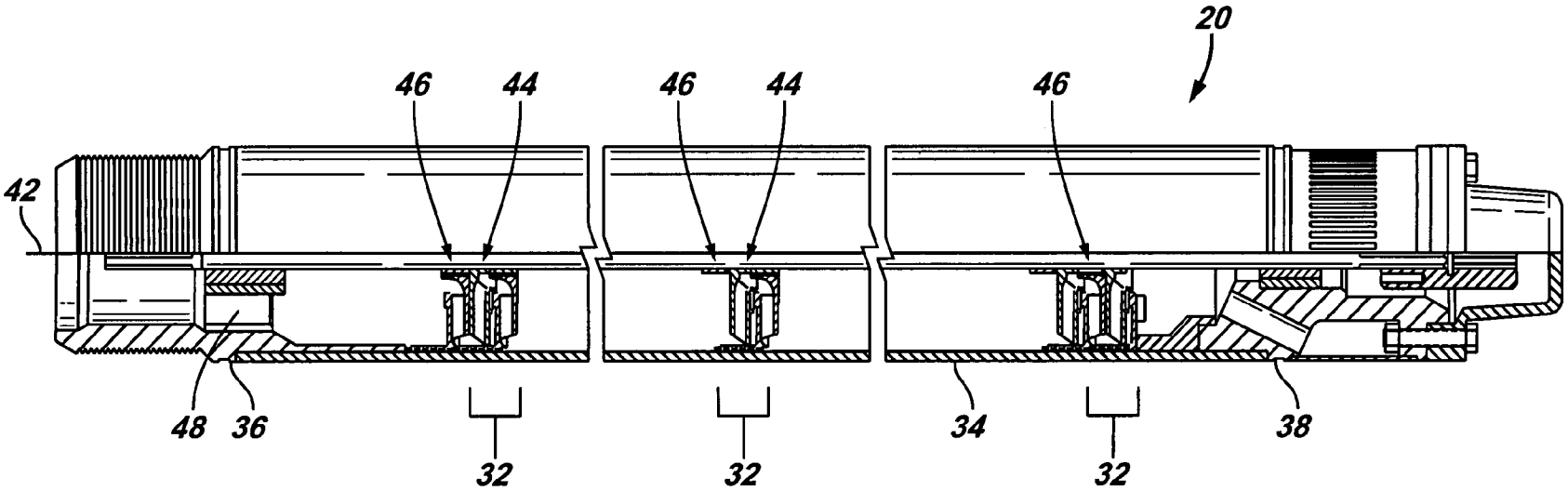
FIG. 2 is a partial cross-sectional view of an embodiment of the pump illustrated in FIG. 1.

In the illustrated example, submersible pump 20 is a centrifugal pump having one or more stages 32, as illustrated in FIG. 2. In the example illustrated in FIG. 2, only some of the stages 32 are illustrated to facilitate explanation. Submersible pump 20 also comprises an outer housing 34 that is generally circular in cross-section and extends between a first end 36 and a second end 38. A shaft 40 is rotatably mounted with an outer housing 34 generally along an axis 42 of pump 20.

Each stage 32 comprises a diffuser 44 and an impeller 46. Generally, impellers 46 rotate with shaft 40 and may be rotationally affixed to shaft 40 by, for example, a key and keyway. The rotating impellers 46 impart motion to fluid flowing through pump 20 and move the fluid from one stage 32 to the next until the fluid is discharged through flow passages 48 at first end 36. The diffusers 44 are rotationally stationary within outer housing 34 and serve to guide the fluid from one impeller 46 to the next.

Figure 3:
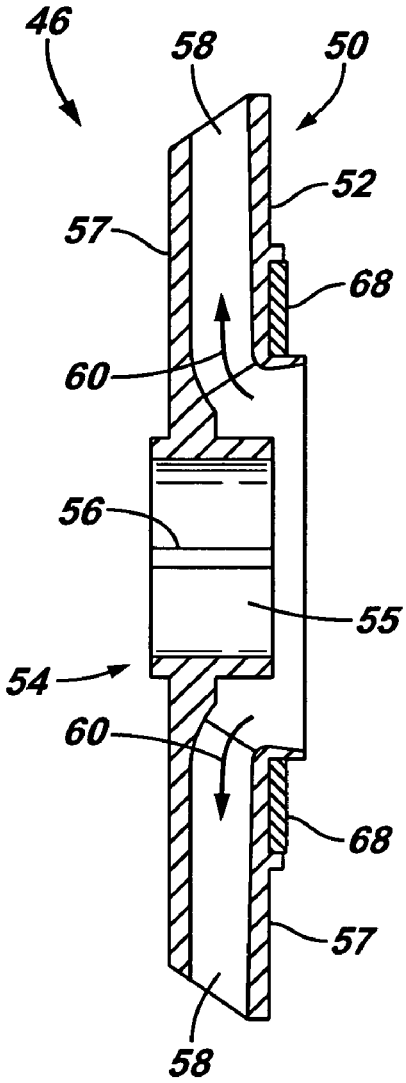
FIG. 3 is a cross-sectional view of a portion of the impeller utilized in the pump illustrated in FIG. 2.

As illustrated best in FIG. 3, each impeller 46 comprises an impeller portion 50 formed from a moldable material 52. Moldable material 52 may comprise a moldable plastic material. In some applications, for example, the moldable material 52 comprises and arlene sulfide polymer, such as polyphenylene sulfide (PPS). PPS enables the formation of impeller portion 50 with a high degree of accuracy of form and smoothness of surface. These properties facilitate the formation of impellers 46 according to a wide variety of design objectives. For example, flow characteristics are readily optimized to enhance pumping efficiency or other pumping parameters.

In the embodiment illustrated in FIG. 3, impeller 46 comprises a central section 54, such as a short hub, having an axial opening 55 therethrough. Axial opening 55 is sized to receive shaft 40, such that impellers 46 may be stacked along the shaft. The impeller may be held in place rotationally with respect to shaft 40 by a key (not shown) received in a keyway 56 formed along the interior of short hub 54. If central section 54 is formed as a short hub, the short hub is axially shortened in the sense that moldable material 52 does not extend axially into the diffuser hub of the next sequential diffuser, a location susceptible to wear due to abrasion. In the example illustrated in FIG. 3, central section 54 is formed as a short hub.

As illustrated, a plurality of vanes 57 extend radially outward from short hub 54. In this embodiment, vanes 57 also are formed from moldable material 52 and integrally molded with short hub 54. Each of the vanes 57 includes an internal flow passage 58 through which fluid flows in the direction of arrow 60 during operation of pump 20. The fluid is directed through corresponding flow passages of the next sequential diffuser, as explained more fully below.

Figure 4:
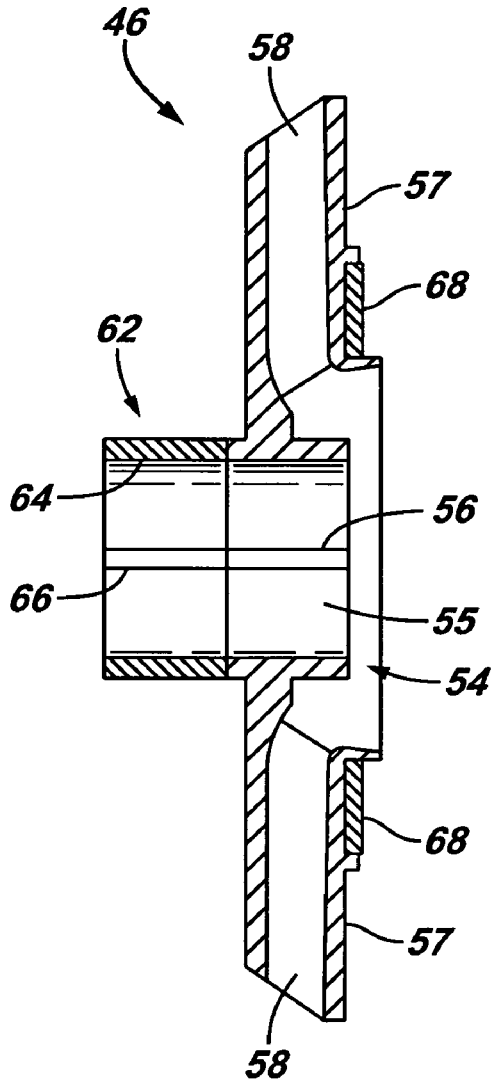
FIG. 4 is a cross-sectional view of an embodiment of the impeller illustrated in FIG. 2.

Each impeller 46 further comprises a sleeve 62, as illustrated best in FIG. 4. Each sleeve 62 is positioned axially adjacent its corresponding short hub 54 such that it extends into the hub of the next adjacent diffuser (see FIG. 2). Thus, sleeve 62 serves as an axial extension of short hub 54, extending into an area susceptible to wear. Accordingly, sleeves 62 are formed from a wear resistant material relative to moldable material 52. For example, sleeves 62 may be formed of a metal material less susceptible to abrasion than moldable material 52. One material that provides good abrasion resistance is a nickel cast iron, such as a ni-resist material. Each sleeve 62 may be formed as a separate component within the impeller 46. Alternatively, the sleeve may be attached to or molded with the moldable material 52.

In the embodiment illustrated, sleeve 62 is generally circular and has an opening 64 sized to slide over shaft 40, similar to short hub 54. Additionally, each sleeve 62 may have a keyway 66 that cooperates with a key along shaft 40 to prevent rotation of sleeve 62 with respect to the shaft. The wear resistant sleeve 62 provides radial support for the impeller and increases bearing and pump life, especially when pumping fluids with substantial particulate content.

The impeller 46 also may comprise a thrust ring 68 disposed between the impeller 46 and the next adjacent diffuser. The thrust ring is disposed on a side of impeller 46 opposite sleeve 62. Thrust ring 68 may be formed of a metal material or other wear resistant material.

Figure 5:
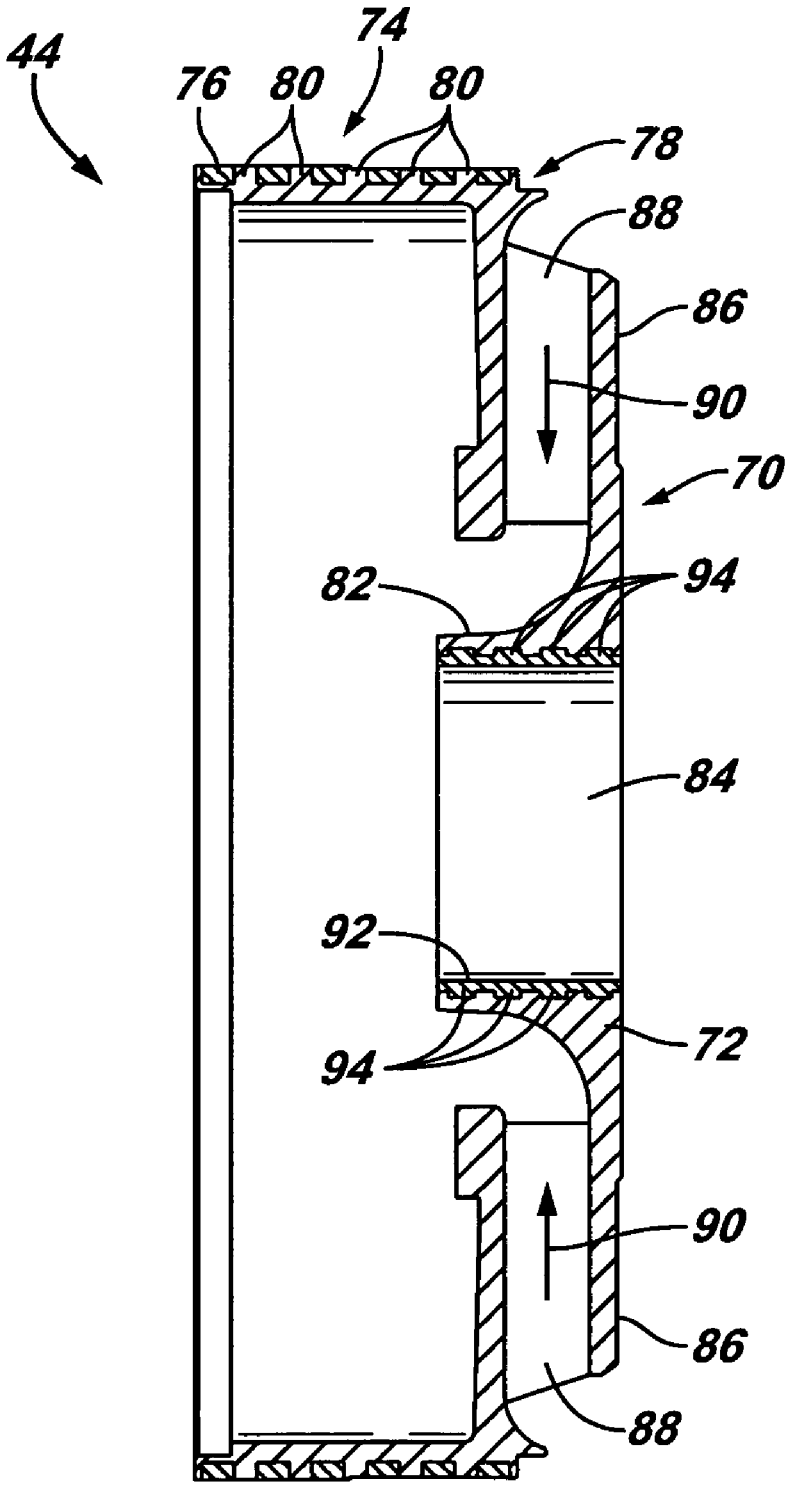
FIG. 5 is a cross-sectional view of an embodiment of a diffuser utilized in the pump illustrated in FIG. 2.

Referring generally to FIG. 5, an embodiment of diffuser 44 is illustrated. In this embodiment, diffuser 44 is a composite diffuser in which a portion 70 of the diffuser is formed from a moldable material 72. The moldable material 72 facilitates formation of diffuser designs that enhance pumping characteristics, such as pumping efficiency, similar to that described above with respect to impellers 46. Moldable material 72 may be a moldable plastic, such as an arlene sulfide polymer. For example, PPS is a material that is readily moldable and can be formed with a smooth surface texture to enhance flow characteristics The illustrated diffuser 44 also comprises a reinforcement member 74 able to reinforce moldable material 72. For example, reinforcement member 74 may comprise a ring 76 disposed circumferentially along a radially outlying region 78 of diffuser 44. Ring 76 comprises a plurality of gripping features 80 that hold ring 76 in place with respect to moldable material 72. For example, gripping features 80 may comprise perforations formed through ring 76, as illustrated. In the embodiment of FIG. 5, reinforcement member 74 is integrally molded with moldable material 72, and thus is fixed in place along radially outlying region 78 of the diffuser. Furthermore, ring 76 may be formed of a metal material, such as nickel cast iron, e.g. ni-resist, or stainless steel.

Diffuser 44 comprises a hub portion 82 having an axial opening 84 sized to rotatably receive sleeve 62 of the next adjacent impeller 46. A diffuser body portion 86 extends from hub portion 82 to radially outlying region 78. Body portion 86 has a plurality of diffuser flow passages 88 for directing fluid in the direction of arrows 90 as the fluid moves from an upstream impeller to the next sequential downstream impeller. Each diffuser 44 also may comprise a bearing sleeve 92 disposed along the interior of hub portion 82. Bearing sleeve 92 may be formed of a wear resistant material, such as a metal material, e.g. ni-resist or stainless steel. As illustrated, bearing sleeve 92 has a plurality of external gripping features, e.g. protuberances 94 that extend radially outward into the moldable material 72 of hub portion 82. These features secure bearing sleeve 92 within diffuser 44. Bearing sleeve 92 provides a wear resistant material in which sleeve 62 of the next adjacent impeller 46 rotates during operation of pump 20. Bearing sleeve 92 also can serve as a second reinforcement member to structurally reinforce diffuser 44.

The composite diffuser 44 enables, for example, greater accuracy of form and smoothness of surface due to moldable material 72. Simultaneously, reinforcement member 74 provides added strength to resist mechanical loads and pressure loads. It should be noted that reinforcement member 74 may have other configurations or be formed of other materials. For example, the member may be formed of wire mesh or be formed as single or multiple reinforcement components disposed along radially outlying region 78 and/or along body portion 86 or hub portion 82.

Although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A pumping system, comprising:

a submersible, centrifugal pump having an outer housing, a shaft, a plurality of diffusers mounted within the outer housing and a plurality of impellers mounted about the shaft, each impeller having a short hub formed of a moldable plastic and a sleeve axially adjacent the short hub, wherein the sleeve is positioned about the shaft for rotation within a next adjacent diffuser, the sleeve being formed of a non-plastic material able to better withstand abrasive wear relative to the moldable plastic.

2. The pumping system as recited in claim 1, wherein the sleeve is a metal sleeve.

3. The pumping system as recited in claim 1, wherein the sleeve is a nickel cast iron sleeve.

4. The pumping system as recited in claim 1, wherein the moldable plastic comprises an arlene sulfide polymer.

5. The pumping system as recited in claim 1, wherein the moldable plastic comprises a polyphenylene sulfide (PPS) material.

6. The pumping system as recited in claim 1, wherein each diffuser comprises a moldable plastic.

7. The pumping system as recited in claim 6, wherein each diffuser comprises at least one metal reinforcement member molded into the moldable plastic.

8. The pumping system as recited in claim 7, wherein the moldable plastic comprises PPS.

9. The pumping system as recited in claim 1, wherein each impeller has a plurality of moldable plastic vanes extending from the short hub.

10. An electric submersible pumping system, comprising:

a submersible motor;

a motor protector; and a submersible pump with a plurality of stages, each stage having an impeller with a plurality of vanes, and a sleeve that rotates with the plurality of vanes, the plurality of vanes being formed of a moldable plastic and the sleeve being formed of a material having greater wear resistance than the moldable plastic.

11. The electric submersible pumping system as recited in claim 10, wherein the sleeve is a metal sleeve.

12. The electric submersible pumping system as recited in claim 11, wherein the moldable plastic comprises PPS.

13. The electric submersible pumping system as recited in claim 10, wherein the impeller comprises a short hub formed of the moldable plastic and integrally molded with the plurality of vanes, the sleeve being disposed axially adjacent the short hub.

14. The electric submersible pumping system as recited in claim 10, wherein each stage has a diffuser comprising a moldable material.

15. The electric submersible pumping system as recited in claim 14, wherein the moldable material is the same type of moldable plastic used to formed the plurality of vanes.

16. The electric submersible pumping system as recited in claim 14, wherein the diffuser comprises at least one reinforcement member molded into the moldable material.

17. A pumping system, comprising:

a submersible, centrifugal pump having an outer housing, a shaft, a plurality of diffusers mounted within the outer housing and a plurality of impellers mounted about the shaft, each diffuser being formed of a moldable material and a reinforcement member molded into the moldable material, the reinforcement member being disposed generally circumferentially along a radially outlying region of the diffuser.

18. The pumping system as recited in claim 17, wherein the moldable material comprises PPS.

19. The pumping system as recited in claim 17, wherein the reinforcement member is a metal ring having surface features to grip the moldable material.

20. A method of creating an impeller for a centrifugal, submersible pump having a plurality of stages through which a liquid is pumped, comprising:

forming a short hub and a plurality of attached impeller vanes from a moldable material; and positioning a wear resistant sleeve axially adjacent the short hub to create a longer hub, the wear resistant sleeve being formed of a material having greater wear resistance than the moldable material, the wear resistant sleeve extending into an area more susceptible to wear.

21. The method as recited in claim 20, wherein forming comprises forming the short hub and the plurality of attached impeller vanes from a moldable plastic.

22. The method as recited in claim 20, wherein forming comprises forming the short hub and the plurality of attached impeller vanes from PPS.

23. The method as recited in claim 20, wherein positioning comprises positioning a wear resistant metal sleeve.

24. The method as recited in claim 20, wherein positioning comprises positioning a wear resistant nickel-resist sleeve.

25. A method of creating a centrifugal, submersible pump having a plurality of stages through which a liquid is pumped, comprising:

forming a composite diffuser with a stiffening member integrally molded into a moldable plastic material such that the stiffening member is at least partially disposed at a radially outlying region of the composite diffuser.

26. The method as recited in claim 25, further comprising positioning the composite diffuser and an impeller in each stage.

27. The method as recited in claim 26, creating each impeller from a combination of the moldable plastic material and a wear resistant sleeve.

28. The method as recited in claim 25, wherein forming comprises forming the diffuser with a stiffening member being a metal ring.

29. The method as recited in claim 25, wherein forming comprises molding the stiffening member into PPS.

30. The method as recited in claim 26, further comprising forming the impeller with a short hub and vanes, molded from PPS, and a nickel-resist sleeve adjacent the short hub.

31. A device for use in a centrifugal pump, comprising:

a composite diffuser formed of a moldable material and a reinforcement member integrally molded into the moldable material at a radially outlying region of the composite diffuser.

32. The device as recited in claim 31, wherein the moldable material is a moldable plastic material.

33. The device as recited in claim 32, wherein the reinforcement member comprises a metal material.

34. The device as recited in claim 31, wherein the reinforcement member comprises a ring having a plurality of gripping features.

35. The device as recited in claim 31, wherein the reinforcement member comprises a plurality of reinforcement members.

36. A device for use in a centrifugal pump, comprising:

an impeller having a plurality of vanes extending radially from a central section and a sleeve extending axially from the central section to provide a wear surface, the plurality of vanes being formed from a moldable material and the sleeve being formed from a material comprising nickel-resist to provide greater wear resistance than the moldable material.

37. The device as recited in claim 36, wherein the moldable material is a moldable plastic.

38. The device as recited in claim 37, wherein the sleeve is a metal sleeve.

* * * * *

UNITED STATES PATENT AND TRADEMARK OFFICE

CERTIFICATE OF CORRECTION

PATENT NO. : 6,979,174 B2 
APPLICATION NO. : 10/676319
DATED : December 27, 2005
INVENTOR(S) : Watson et al.

It is certified that error appears in the above-identified patent and that said Letters Patent is hereby corrected as shown below:

Title Page, Item
(75) Inventors, the Inventorship should read as follows:

Arthur I. Watson, Sugar Land, TX (US); Dwight C. Chilcoat, Fresno, TX (US); Diego A. Narvaez, Missouri City, TX; Joseph C. Liu, Ramona, OK; Kentankumar K. Sheth, Tulsa, OK Signed and Sealed this Fifth Day of December, 2006

JON W. DUDAS
*Director of the United States Patent and Trademark Office*